US005365626A

United States Patent [19]

Santi

[11] Patent Number: 5,365,626

[45] Date of Patent: Nov. 22, 1994

[54] SWIMMING POOL TILE BRUSHING DEVICE

[76] Inventor: Raymond M. Santi, 924 Forest Ave., Deerfield, Ill. 60015

[21] Appl. No.: 32,116

[22] Filed: Mar. 17, 1993

[51] Int. Cl.[5] ..... A46B 13/00; A47L 11/38

[52] U.S. Cl. ..... 15/49.1; 15/1.7

[58] Field of Search ..... 15/1.7, 49.1, 50.1

[56] References Cited

U.S. PATENT DOCUMENTS

| | | | |
|---|---|---|---|
| 4,324,015 | 4/1982 | Head | 15/1.7 |
| 4,542,549 | 9/1985 | Keller | 15/1.7 |
| 4,604,766 | 8/1986 | Avery | 15/1.7 |
| 4,754,580 | 7/1988 | Mattson | 15/49.1 |

FOREIGN PATENT DOCUMENTS

| | | | |
|---|---|---|---|
| 2138194 | 3/1973 | Germany | 15/1.7 |

*Primary Examiner*—Edward L. Roberts

*Attorney, Agent, or Firm*—Thomas R. Vigil

[57] ABSTRACT

The device for brushing sides of in the ground swimming pools or ceramic tiles mounted on sides of in the ground swimming pools having a pool deck and a coping around a perimeter of the pool deck comprises a housing, a drive shaft mounted in the housing, wheels mounted on the drive shaft, a handle extending upwardly from the housing, an extension member extending downwardly from the housing, a brush assembly for brushing the sides of the pool rotatably mounted to the extension member, and structure coupled to the drive shaft and the brush assembly for rotating the brush assembly when the housing is moved along the deck of the pool.

13 Claims, 3 Drawing Sheets 32
82
74
78
70
64
65
66
76
68
72
34
30
36
38
44
50
63
62
60
52
58

61'
56
54'
61
48
54
46

SWIMMING POOL TILE BRUSHING DEVICE

BACKGROUND OF THE INVENTION

1. Field of the Invention

The present invention relates to a swimming pool tile cleaning device for use with an in the ground swimming pool. More particularly, the swimming pool tile cleaning device of the present invention is used to remove dirt and oils which accumulate on ceramic tiles on the sides of a pool at the waterline. Ceramic tiles are generally located only at an area near the top of the wall, just below a coping which surrounds the perimeter of the pool.

2. Description of the Related Art Including Information Disclosed Under 37 CFR §§1.97–1.99

A problem that occurs in swimming pools is a scum accumulation commonly known as "bathtub ring", that adheres to the sides of a swimming pool (usually having a ceramic tile border) at the water level. This "bathtub ring" is the product of swimmers' body oils and/or various sun tanning lotions and oils combined with wind-blown dust and contaminants floating on the surface of the water and finally adhering to the sides of the pool.

Heretofore, various methods and devices have been used to clean the ceramic tiling of in the ground swimming pools. Examples of prior devices for cleaning ceramic tiles on in the ground swimming pools can be found in the following Patents:

| U.S. Pat. No. | Patentee |
|---|---|
| 4,604,766 | Avery |
| 4,542,549 | Keller |
| 4,324,015 | Head |
| **German Patent No.** | **Inventor** |
| 2 138 194 | Otto Ritter |

The Avery U.S. Pat. No. 4,604,766 discloses a cleaning device for removing calcium build-up in pools which occurs substantially at or above a water line in the pool. The cleaning device includes a frame which can be placed on a ledge surrounding the pool. A wheel on the frame causes the frame to be move along the pool edge and generally away from the pool . The wheel is driven by a motor which is mounted on the frame. A shaft extends downwardly from and is rotatably mounted to the frame. A wire brush is mounted at the end of the shaft, extends into the pool and abuts against the pool wall. The shaft is rotated by a second motor, which is also mounted on the frame. As the shaft rotates, the is rotated, striking the wall of the pool and removing the calcium build-up.

The Keller U.S. Pat. No. 4,542,549 discloses a swimming pool cleaning device for cleaning an upper edge portion of a swimming pool side wall near a water level line. The device is hand driven along the edge of the pool and includes a handle bar having a short horizontally extending section at a lower end of the handle bar. A wheel is mounted to the handle bar at the lower end. A mounting plate is attached to the horizontal section of the handle bar and a scrubbing pad is mounted to the to the mounting plate. The pad is positioned to engage the pool wall when the device is rolled along the edge of the pool. In one embodiment, the pad can be mounted such that when the device is pushed along the edge of the pool, the pad will move up and down to provide a more vigorous scrubbing action.

The Head U.S. Pat. No. 4,324,015 discloses a swimming pool cleaning device including a handle mounted to a housing having transverse tandem wheels which ride along an upper perimeter of the pool. The housing includes an offset portion which extends over an edge of the pool itself and a rotary brush is mounted to a shaft which is driven by a motor located within the housing. The rotary brush contacts the upper wall surface of the waterline for cleaning tiles of the pool wall.

The Ritter German Patent No. 2 138 194 discloses a device for cleaning (commercial or industrial)??? swimming pool walls having a power driven, rotating brush mounted on a carriage which travels on the perimeter of the pool. The brush is mounted on a vertical spindle which is connected to an electric motor. The vertical position of the brush is adjustable, up or down. The carriage, which can be either hand or power propelled, is mounted on two wheels which travel along a vertical U-shaped gutter of the pool. A portion of the device extends into the U-shaped gutter The device also has two horizontal rollers which are mounted to brackets on the underside of the carriage. The rollers run along the pool wall and are positioned below the brush.

SUMMARY OF THE INVENTION

According to the present invention there is provided a device for brushing sides of or ceramic tiles mounted on sides of in the ground swimming pools having a pool deck and a coping around a perimeter of the pool deck. The device comprises a housing, a drive shaft mounted in the housing, wheels mounted on the drive shaft, a handle extending upwardly from the housing, an extension member extending downwardly from the housing, a brush assembly for brushing the sides of the pool rotatably mounted to the extension member, and structure coupled to the drive shaft and the brush assembly for rotating the brush assembly when the housing is moved along the deck of the pool.

DESCRIPTION OF PREFERRED EMBODIMENTS

Figure 1:
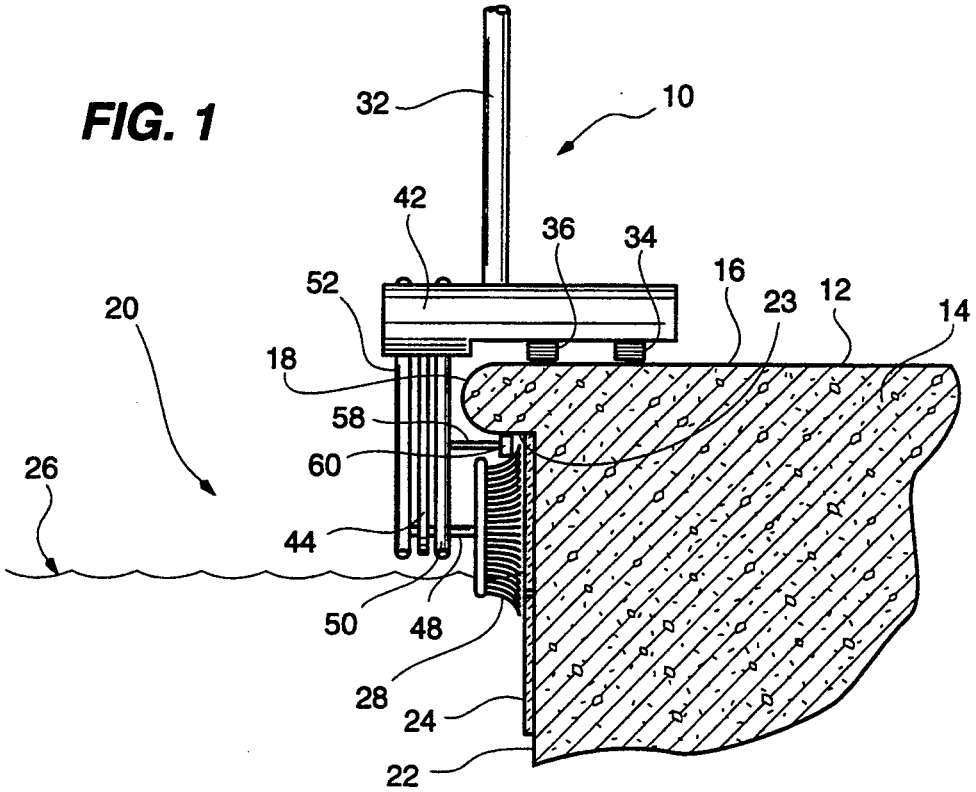
FIG. 1 is a front view of one embodiment of a device constructed according to the teaching of the present invention for brushing swimming pool walls, shown properly positioned on a swimming pool deck.

While the swimming pool tile brushing device of the present invention is susceptible of several constructions, there is shown in FIGS. 1–4 one preferred embodiment the device constructed according to the teachings of the present invention, with the understanding that the present disclosure is not intended to be limited to the specific construction illustrated in the drawings.

Figure 2:
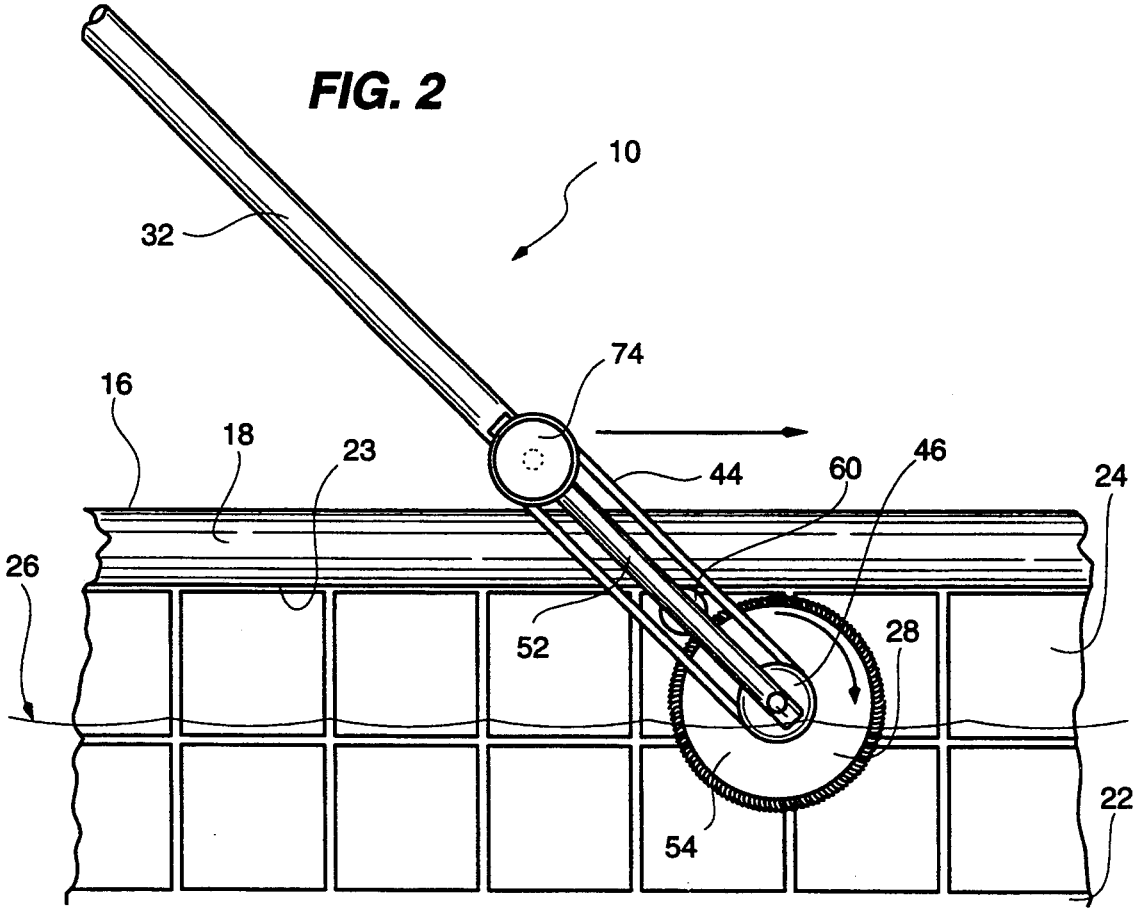
FIG. 2 is a side view of the device shown in FIG. 1 properly positioned on a swimming pool deck.

As shown in FIGS. 1 and 2 a swimming pool tile brushing device 10 is positioned on a deck 12 of an in the ground swimming pool 14. The swimming pool 14 as shown has a horizontal deck surface 16 and a coping 18 extending from the deck surface 16 into an interior pool area 20. A vertical side wall 22 of the pool 14 extends downwardly from a bottom side 23 of the coping 18. Ceramic tiling 24 is attached to the vertical wall 22. The water 26 in the pool 14 is shown rising to a height of approximately the center of the tiling 24.

Figure 3:
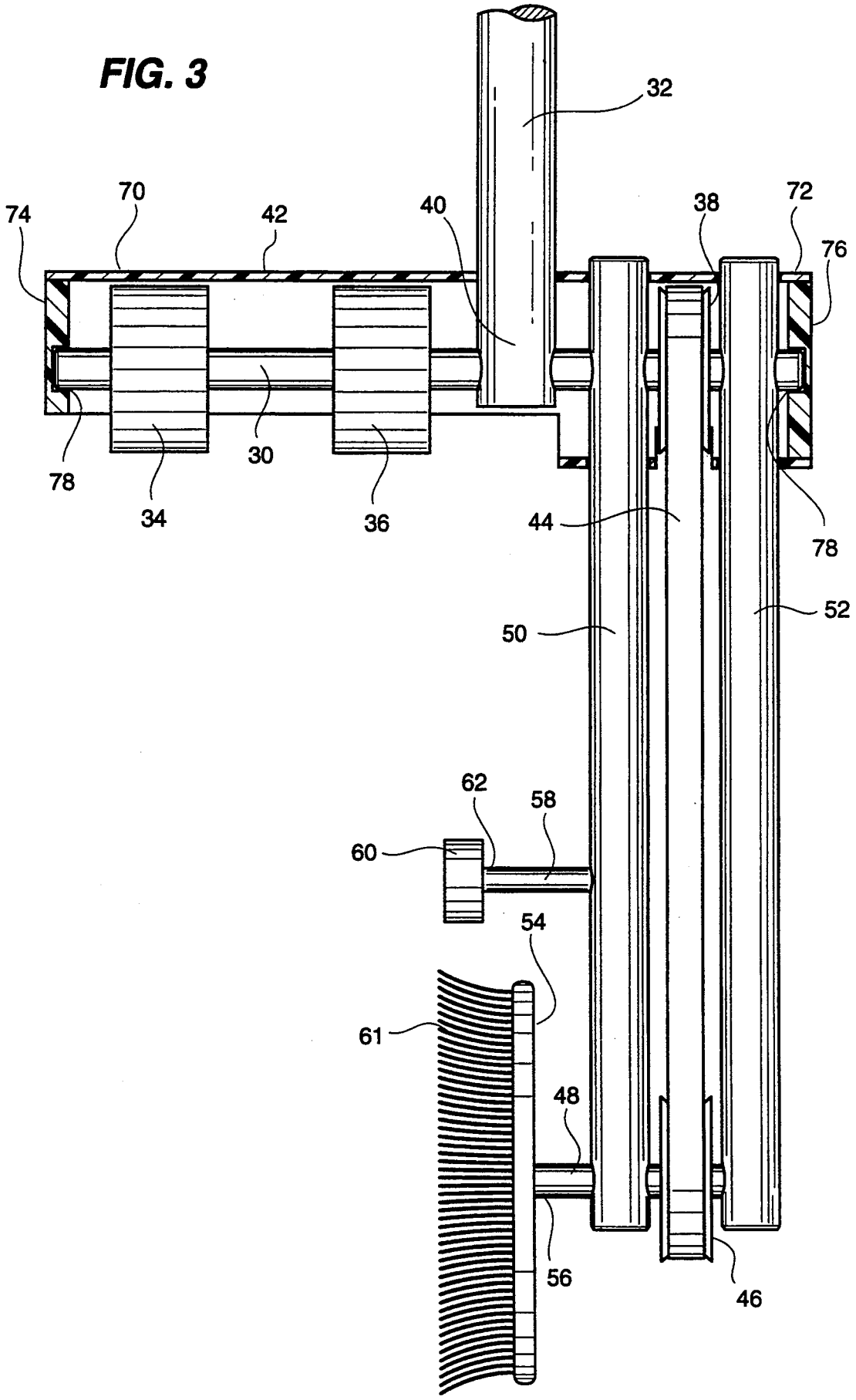
FIG. 3 is a rear view of a lower portion of the device shown in FIG. 1.
Figures 4, 5:
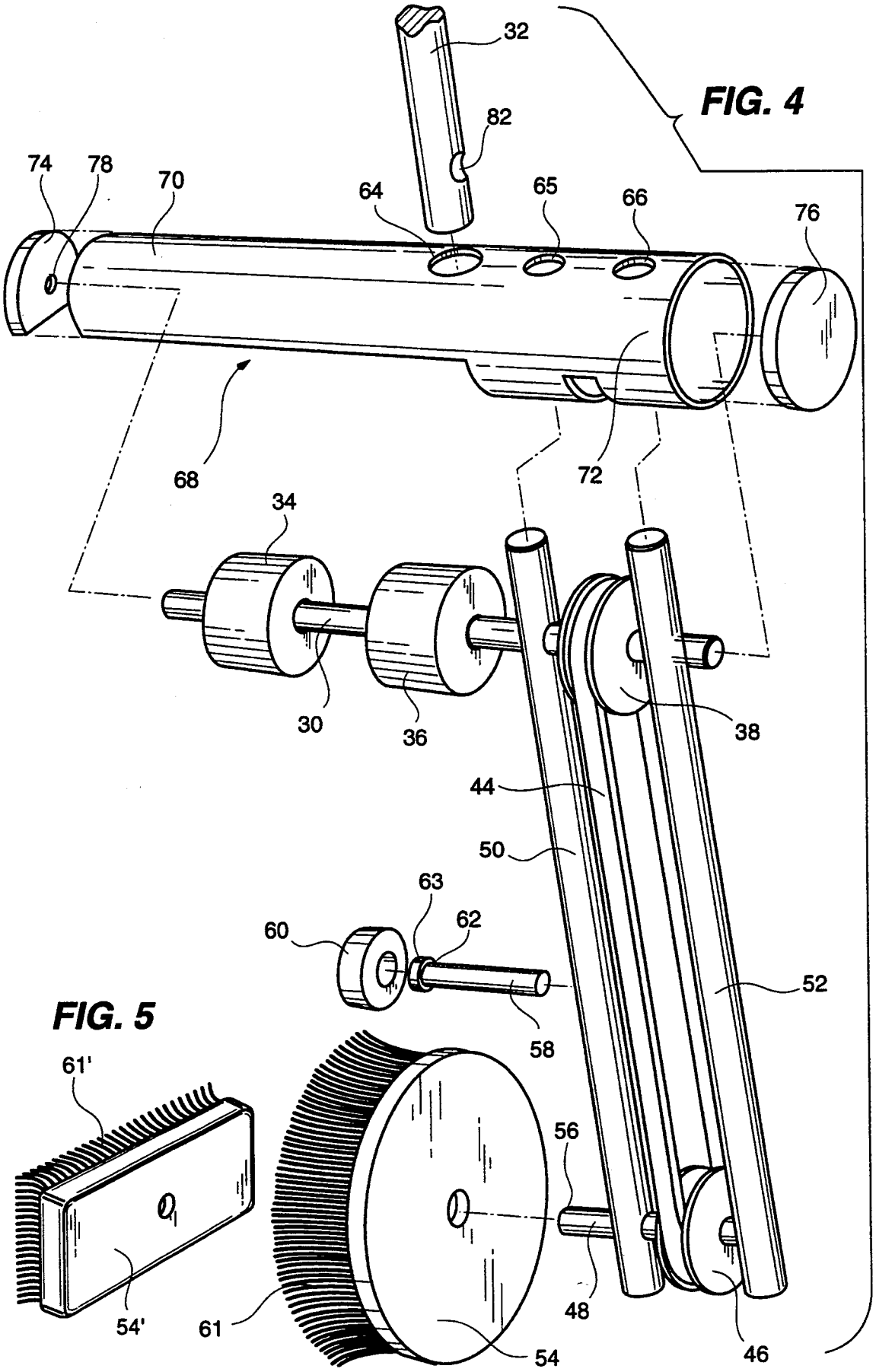
FIG. 4 is an exploded perspective view of the device shown in FIG. 3.
FIG. 5 is a perspective view of a modified brush for use with the device shown in FIG. 4.

As shown in FIGS. 3 and 4 the device 10 includes a drive shaft 30 which is rotatably mounted to an elongate handle 32. Two drive wheels 34, 36 and a first flanged pulley 38 are mounted on the drive shaft 30.

Note that the drive shaft 30, the drive wheels 34 and 36, the first flanged pulley 38 and a lower end portion 40 of the handle 32 are all positioned within a tubular housing 42.

Two elongate tubular members 50, 52 extend downwardly from the housing 42 and are also mounted on the drive shaft 30. A first axle 48, is rotatably mounted to the two elongate tubular members 50, 52. A timing belt 44 is attached around the first flanged pulley 38 and around a second flanged pulley 46 which is mounted on a first axle 48. The first axle 48 is positioned below the drive shaft 30. A scrub brush 54 is rotatably mounted at an outer end 56 of the first axle 48.

A second axle 58 is attached to one of the tubular menders 50. The second axle 58 has a bearing 63 rotatably mounted at an outer end 62 thereof. A guide wheel 60 is mounted on the bearing 63.

As shown in FIGS. 1 and 2, when the brushing device 10 is properly positioned on a pool deck 12, the drive wheels 34, 36 are positioned on the deck surface 16 and the guide wheel 60 is positioned on the bottom side 23 of the coping 18. The device 10 then can be moved in the direction shown in FIG. 2, causing the drive wheels 34, 36 to roll along the deck surface 16. The rolling wheels 34, 36 cause the drive shaft 30 to rotate.

The rotating drive shaft 30 in turn causes the first flanged pulley 38 to rotate. When the first flanged pulley 38 rotates, the belt 44 is driven and causes the second flanged pulley 46 to rotate, which in turn causes the first axle 48 and the brush 54 to rotate.

Also, as shown in FIGS. 1 and 2, when the device 10 is properly positioned, the bristles 61 of the brush 54 contact the side wall 22 and/or ceramic tiles 24 just below the coping 18. Thus, the rotating brush 54 brushes scum off of the ceramic tiles 24 of the swimming pool 14.

In the embodiment shown in FIGS. 3 and 4, the housing 42 is made from 3.0 inch diameter P.V.C. tubing and is approximately 12.0 inches long. The 3.0 inch P.V.C. tubing has several 1.0 inch diameter holes 64, 65, 66 therein and also has a custom cut out section 68 to allow the drive wheels 34, 36 to roll on the deck surface 16 without the housing 42 obstructing the wheels 34, 36. The wheels 34, 36 as shown are made of rubber and have an outer diameter of approximately 2.5 inches.

At a left end 70 and a right end 72 of the housing 42 are 3 inch diameter end plates 74, 76 with a 0.5 inch diameter hole 78 in the center of the plates 74, 76. The holes 78 receive the drive shaft 30 which is made of aluminum and has a diameter of approximately 0.5 inches and allow the shaft 30 to rotate freely. The first flanged pulley 38 has a diameter of approximately 2.0 inches and is fastened securely to the drive shaft 30 by set screws (not shown). The drive shaft 30 is threaded through a bore 82 in the handle 32 and the two extension members 50, 52 so as to allow free rotation and stability of the drive shaft 30. The extension members 50, 52 are made of PVC tubing having a diameter of approximately 0.75 inches.

Since most pools are different and have differing water levels and tile sizes the stabilizing guide wheel 60 attached to the second axle 58 engages the bottom side 23 of the coping 18 and can be raised or lowered to allow the cleaning device 10 to brush the vertical wall or tiling at a desired height. The second axle 58 as shown is a bolt having a diameter of approximately 0.25 inches. The bolt is secured to the extension member by a nut (not shown).

One brush 54 that can be used is circular and has a diameter of approximately 6.0 inches. Another brush 54 that can be used is rectangular. The brush 54 is mounted at the outer end 56 of the first axle 48 which is made of aluminum and is approximately 6.0 inches long and has a diameter of approximately 0.5 inches.

What is claimed is:

1. A device for use with in the ground swimming pools having a pool deck and a coping around a perimeter of the pool deck, for brushing sides of the pool or ceramic tiles mounted on sides of the pool, comprising:
   - a housing;
   - a drive shaft mounted in said housing;
   - wheels mounted on said drive shaft, said wheels engaging a planar surface of the pool deck and rotating said drive shaft;
   - a handle extending upwardly from said housing;
   - an extension member extending downwardly from said housing;
   - a brush assembly for brushing the sides of the pool rotatably mounted to said extension member; and
   - means coupled to said drive shaft and said brush assembly for rotating said brush assembly when said housing is moved along the deck of the pool.

2. The device of claim 1 further comprising:
   - guide means on said extension member for guiding and securing the brushing device to the coping of the pool.

3. The device of claim 2 wherein said guide means includes an axle mounted to said extension member and a guide wheel mounted on an outer end of said axle.

4. The device of claim 1, wherein said brush assembly includes an axle mounted to said extension member and a brush mounted to said axle.

5. The device of claim 4 wherein said means for rotating said brush assembly includes a first pulley on said drive shaft, a second pulley on said axle and a belt looped around said pulleys.

6. The device of claim 4 wherein said brush is circular and approximately 6 inches in diameter.

7. The device of claim 4 wherein said brush is rectangular.

8. The device of claim 1 wherein said wheels are approximately 2" in diameter.

9. The device of claim 1 wherein said housing is made of PVC tubing.

10. A device, for use with in the ground swimming pools having a pool deck and a coping around a perimeter of the pool deck, for brushing sides of the pool or ceramic tiles mounted on sides of the pool, comprising:
   - a housing;
   - a drive shaft mounted in said housing;
   - a handle extending upwardly from said housing;
   - an extension member extending downwardly from said housing;
   - a brush assembly rotatably mounted to said extension member and coupled to said drive shaft; and wheel means coupled to said drive shaft, said wheel means for engaging a planar surface of the pool deck and for rotating said drive shaft and said brush assembly.

11. The device of claim 10 further comprising:

guide means on said extension member for guiding and securing the brushing device to the coping of the pool.

12. The device of claim 11 wherein said guide means for guiding and securing the brushing device to the coping of the pool includes:

an axle mounted to said extension member; and a guide wheel mounted at an outer end of said axle.

13. The device of claim 10 wherein said brush assembly includes:

an axle mounted to said extension member; and a brush mounted on said axle.

* * * * *